US007307539B2

(12) United States Patent
Harvey et al.

(10) Patent No.: US 7,307,539 B2
(45) Date of Patent: Dec. 11, 2007

(54) HAZARD DETECTION

(75) Inventors: Ann M Harvey, Pangbourne (GB); David A Parry, Wexham (GB)

(73) Assignee: Kidde IP Holdings Limited, Slough, Berkshire (GB)

( * ) Notice: Subject to any disclaimer, the term of this patent is extended or adjusted under 35 U.S.C. 154(b) by 343 days.

(21) Appl. No.: 10/544,562

(22) PCT Filed: Feb. 2, 2004

(86) PCT No.: PCT/GB2004/000321

§ 371 (c)(1),
(2), (4) Date: Aug. 4, 2005

(87) PCT Pub. No.: WO2004/070673

PCT Pub. Date: Aug. 19, 2004

(65) Prior Publication Data

US 2006/0164253 A1 Jul. 27, 2006

(30) Foreign Application Priority Data

Feb. 4, 2003 (GB) ..... 0302527.7

(51) Int. Cl.
*G08B 21/00* (2006.01)

(52) U.S. Cl. ..... 340/627; 340/628

(58) Field of Classification Search ..... 340/577, 340/584, 603, 604, 627, 628, 629, 630, 632, 340/633, 634

See application file for complete search history.

(56) References Cited

U.S. PATENT DOCUMENTS 4,674,062 A * 6/1987 Premerlani ..... 708/3
4,792,797 A * 12/1988 Tanguay et al. ..... 340/628
4,814,748 A 3/1989 Todd ..... 340/527
4,916,432 A 4/1990 Tice et al. ..... 340/5.18
5,736,717 A * 4/1998 Lee et al. ..... 219/720
7,002,478 B2 * 2/2006 Moore et al. ..... 340/577
2001/0038337 A1 11/2001 Wickestead et al. ..... 340/628

FOREIGN PATENT DOCUMENTS

DE 299 11 719 U1 8/2000
GB 2 275 556 A 8/1994
WO 02/063216 A2 8/2002

* cited by examiner

*Primary Examiner*—Van T. Trieu
(74) *Attorney, Agent, or Firm*—Merchant & Gould P.C.

(57) ABSTRACT

In order to allow a smoke detector unit to be utilized in, for example, a domestic kitchen environment, appliances whose operation is commonly associated with the generation of non-hazardous smoke or aerosols are connected to a conventional mains supply socket via a current monitoring unit. The current monitoring units include a radio transceiver, which transmits the operational status of the appliances to a corresponding transceiver of the smoke detector unit 1. If the signals transmitted by the current monitoring units indicate that the appliances and are off, the smoke detector unit generates a warning signal when the smoke density exceeds a lower threshold. If one of the appliances and is detected to be on, the smoke detector unit generates a warning signal only when a second, higher threshold of smoke density is exceeded. Optionally, when the higher smoke density threshold is exceeded; the smoke detector unit transmits the signal to the current monitoring unit to power off the appliances. The invention is also applicable to the detection of other characteristics of ambient fluid, such as temperature or the presence of a particular gas or vapor.

39 Claims, 3 Drawing Sheets

HAZARD DETECTION

TECHNICAL FIELD

The present invention relates to a particle detector for detecting a characteristic of ambient fluid, a detector system and a method of fire protection. The characteristic detected may be the presence of particles, for example, smoke particles, or may be a particular type of gas or vapour, or may be heat.

BACKGROUND ART

In general, the sensing technologies employed in domestic grade smoke detectors are unable to reliably discriminate between smoke or aerosols from genuine fire hazards and those arising from non-hazardous sources such as cooling/burning food, steam etc. Consequently, the occurrence of "false" or nuisance alarms has long been recognised as a limitation of smoke detection in domestic environments. This generally precludes the use of smoke detectors in or near to kitchens; for instance.

Nuisance alarms not only cause annoyance to the consumer, it is quite common for domestic protection systems in the US to be linked directly to the local fire service. False alarms can therefore incur significant costs to homeowners (and businesses), as well as being a drain on fire service resources.

More advanced smoke detection methodologies can introduce an element of nuisance alarm rejection based on intelligent interpretation of multiple parameter measurements. However the cost premium associated with more complex sensing arrangements is not compatible with the low-cost domestic market and, although such enhancements would improve detector integrity, the problem of false alarms would not be adequately resolved for reliable domestic use.

Since detection-level false alarm avoidance is difficult, the more common option is to provide features that override nuisance alarms to limit the disturbance and inconvenience caused. Many basic smoke detector models have no means by which to silence a false alarm. Higher specified models however, often incorporate a "hush" (or otherwise named) feature which essentially allows the end user to temporarily "de-sensitise" a detector, causing alarms due to low-level smoke to be silenced (see, for example, U.S. Pat. No. 4,814,748). It is normal for the "hush" mode to be activated manually via a button on the detector body. In the "hush" mode, smoke detectors remain sensitive to smoke, but operate with a higher alarm threshold. Therefore, if more significant smoke levels are detected whilst the detector is temporarily "de-sensitised", the device will still enter alarm mode. After a pre-defined time period the alarm thresholds are reset to normal. The precise protocol used in such features is stringently governed by the relevant standards.

WO02063216 discloses a system which uses smoke and/or gas detection equipment to monitor the emissions from cooking food in order to control the cooking appliance. The system is incorporated in the cooking device (examples given include toasters, toaster ovens, bread machines and microwave ovens) and actively samples smoke/gas from the main oven/appliance interior into a separate sensing chamber. The measured parameters are fed back to the cooking device and are used to control the appliance settings, e.g. reduce the cooking temperature or vary the cooking time, until the smoke and/or gas levels return to "normal".

GB2275556 discloses a system which is intended to add protection to appliances that use heating elements and are prone to catching fire (washing machines, dryers etc). Essentially, smoke detection apparatus is installed within the body of appliances, so that localised smoke generated within the appliance can be detected and used to alert external smoke detectors to the hazard, i.e. before smoke emerges from within the appliance.

SUMMARY OF INVENTION

The invention is also applicable to the detection of gases or vapours, as well as particles, in ambient fluid.

Further, although limitations of known detector systems employed in the domestic environment have been described above, the invention is of course applicable to gas, vapour and/or particle detection on a larger scale—such as in industrial applications.

Furthermore, the invention is applicable to the detection of characteristics of the ambient fluid, other than the quality of a component therein, such as the temperature of the fluid.

According to a first aspect of the present invention, a detector including detector means for detecting a predetermined characteristic of ambient fluid and for producing a measurement signal indicative of the value of that characteristic of the fluid exceeding an initial threshold value, device detection means for receiving a signal indicative of the operational status of a device known to be associated with the varying of said characteristic and for altering the threshold value in dependence upon that detection, and means for producing a warning signal when the threshold is exceeded.

The characteristic may be the temperature of the fluid, or may be the quantity of a component in the fluid.

The component may be a gas or vapour, or may be particles.

The particles having the "predetermined characteristic" are smoke particles in the exemplary embodiment to be described. The device detection means may detect the operation of a plurality of devices known to be associated with the generation of the particles under normal operation for altering the threshold value in dependence upon that detection. Examples of such devices are toasters, kettles and microwaves. This type of device, when in operation, generates generally non-hazardous particles. Other devices, such as cooker extractor hoods and fans do not themselves generate particles when they are operated, but their operation is associated with the use of another appliance (for example a cooker hob) which does generate non-hazardous particles. The detection of the operation of such devices which are associated with the generation of particles (by another device) is usefully detected in the embodiment. Detecting the operation of such devices associated directly or indirectly with the non-hazardous generation of particles is advantageous because the particle detector may take the operation of these devices into account when calculating whether or not a warning signal should be generated. Advantageously, the particle density in ambient air must exceed a higher threshold when it is detected that an appliance associated with the non-hazardous generation of particles is operational than when no such appliance is operational. Thus, a particle detector in accordance with the present invention may be employed in an environment where hitherto this has not been practicable due to a high risk of false alarms.

Control means for receiving the measurement signal indicative of the density of the particles in the ambient fluid exceeding the threshold value and for operating the device detection means to detect operation of the device in response to the measurement signal is optionally provided. By operating the device detection means (only) in response to the measurement signal exceeding the threshold value, the power consumption of the particle detector may be reduced. This is advantageous particularly when the particle detector is battery-operated (as is common with conventional smoke alarms).

The threshold value may be indicated by, for example, an LED. The LED may be illuminated when the threshold value is altered.

The particle detector may include means for selectively deactivating the device. For example, this means could include a transmitter for transmitting a signal to a receiver associated with the device, instructing that the power supply to the device is cut off.

Conveniently, the signal may be transmitted wirelessly.

Also conveniently, the device detection means may include a receiver for receiving by wireless communication a signal indicative of the operational state of the device.

According to a second aspect of the present invention, there is provided a detector system including detection means for detecting a predetermined characteristic of ambient fluid and for producing a measurement signal indicative of the value of said characteristic of the fluid exceeding an initial threshold value, monitoring means for producing a monitoring signal indicative of the operation of a device, the operation of which device is associated with the varying of said characteristic, and means for receiving the monitoring signal and for altering the threshold value in dependence upon the signal, and means for producing a warning signal when said threshold value is exceeded.

According to a third aspect of the present invention, there is provided a method of fire protection including providing detection means for detecting a predetermined characteristic of ambient fluid and for producing a measurement signal indicative of the value of the characteristic; providing one or more known devices, the operation of which is associated with varying said characteristic, with monitoring means for providing a signal to the detection means indicative of the operational status of the device with which the monitoring means is associated; monitoring the measurement signal to determine whether it exceeds an initial threshold value; in response to the exceeding of said threshold value, obtaining and analysing the signal from the or each monitoring device, and producing a warning signal if said analysis indicates that the device is inoperative, and otherwise increasing the threshold value temporarily and producing a warning signal if the increased threshold value is exceeded.

BRIEF DESCRIPTION OF DRAWINGS

A detector, a detector system and a method of fire protection embodying the invention will now be described by way of example, with reference to the accompanying drawings, in which.

DETAIL DESCRIPTION OF THE INVENTION

The embodiment to be described relates to a system in which smoke particles are detected and in which data relating to the status of various devices or appliances associated with smoke generation is gathered and is used in conjunction with the smoke detection data in order to provide a system which reliably and sensitively provides a warning of a fire hazard but which has a reduced tendency to generate false alarms. For example, such false alarms have previously been generated when smoke alarms have been employed in or in close proximity to kitchens, where smoke and steam generated by cooking and heating water have activated the smoke alarm, when such smoke is not indicative of a fire hazard. Similar problems have occurred when smoke detectors have been employed in or in close proximity to bath and shower rooms, where the steam generated by hot water has led to false alarms. Hitherto, these problems have been so severe that conventionally smoke alarms are not employed in kitchens or bath and shower rooms in the domestic environment.

Figure 1:
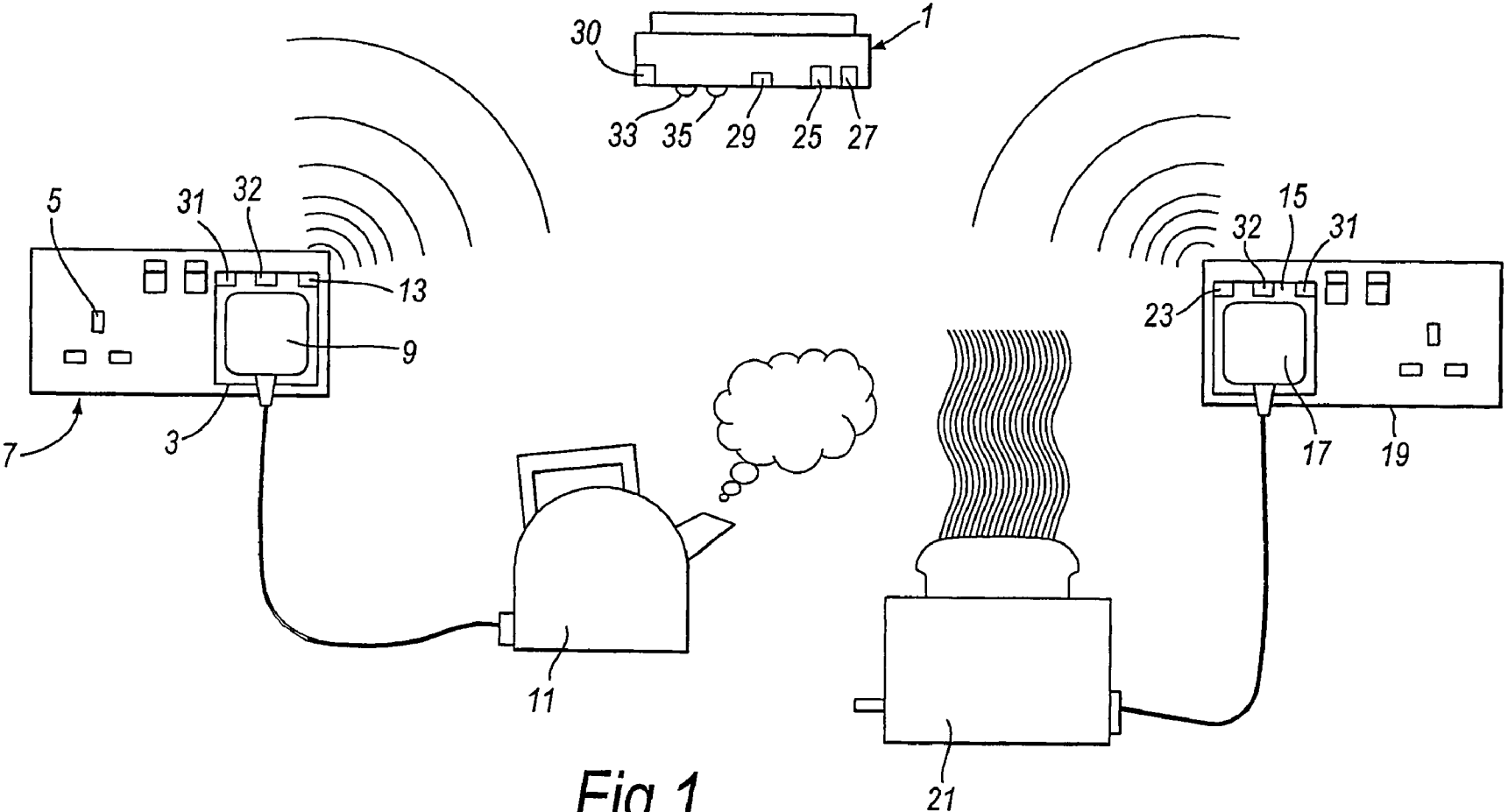
FIG. 1 shows schematically the particle detector system.

FIG. 1 shows schematically a smoke detector unit 1 which is typically positioned on the ceiling of a room, in this example a domestic kitchen. The smoke detector unit 1 includes a conventional arrangement for detecting the density of particles in the ambient air to produce a signal indicative of the smoke density. The processing of this signal within the smoke detector unit 1 will be described further below.

The detection system further comprises a current monitoring unit 3. Extending from one side of the current monitoring unit 3 are three male conducting pins configured to cooperate with the three pin-receiving holes 5 of a conventional United Kingdom 240 volt mains supply socket 7. The opposite side of the current monitoring unit 3 has formed therein 3 pin receiving sockets for receiving the three conductive pins of a conventional United Kingdom domestic appliance electrical plug 9. The current monitoring unit 3 is of similar size, appearance and configuration to a conventional automatic timer unit used to control the operation of mains powered devices.

The current control unit 3 receives mains power from the socket 7 and provides this power to an appliance, in this example a kettle 11, in order to allow that appliance to function in the normal manner.

The current monitoring unit 3 includes a radio transmitter 13, which continuously transmits a radio signal indicating whether the appliance (kettle 11) is drawing a current, and is therefore in operation. The radio transmitter 13 is powered by the mains supply to the socket 7.

A second current monitoring unit 15, similar to the first current monitoring unit 3 is provided between the plug 17 and mains supply socket 19 of a second electrical appliance (a toaster 21). The second current monitoring unit 15 includes a radio transmitter 23 which constantly transmits a signal indicative of whether a current is being drawn by the appliance (toaster 21). This signal is transmitted by the radio transmitters 13 and 23 may be identical, or may have different characteristics in order to allow them to be distinguished from one another by a receiver (for example, they may have different frequencies or may have encoded therein an identifier signal recognisable by a receiver).

The smoke detector unit 1 includes a receiver 25 for receiving the signals transmitted by the transmitters 13 and 23. The smoke detector unit 1 also includes a control unit 27 for processing the signals received by the receiver 25 and also the signal generated by the particle detector of the smoke detector unit 1. A warning signal output device in the form of a piezo electric loudspeaker 29 is provided to allow an audible warning to be made when the control unit 27 determines that there is a fire risk.

Figure 2:
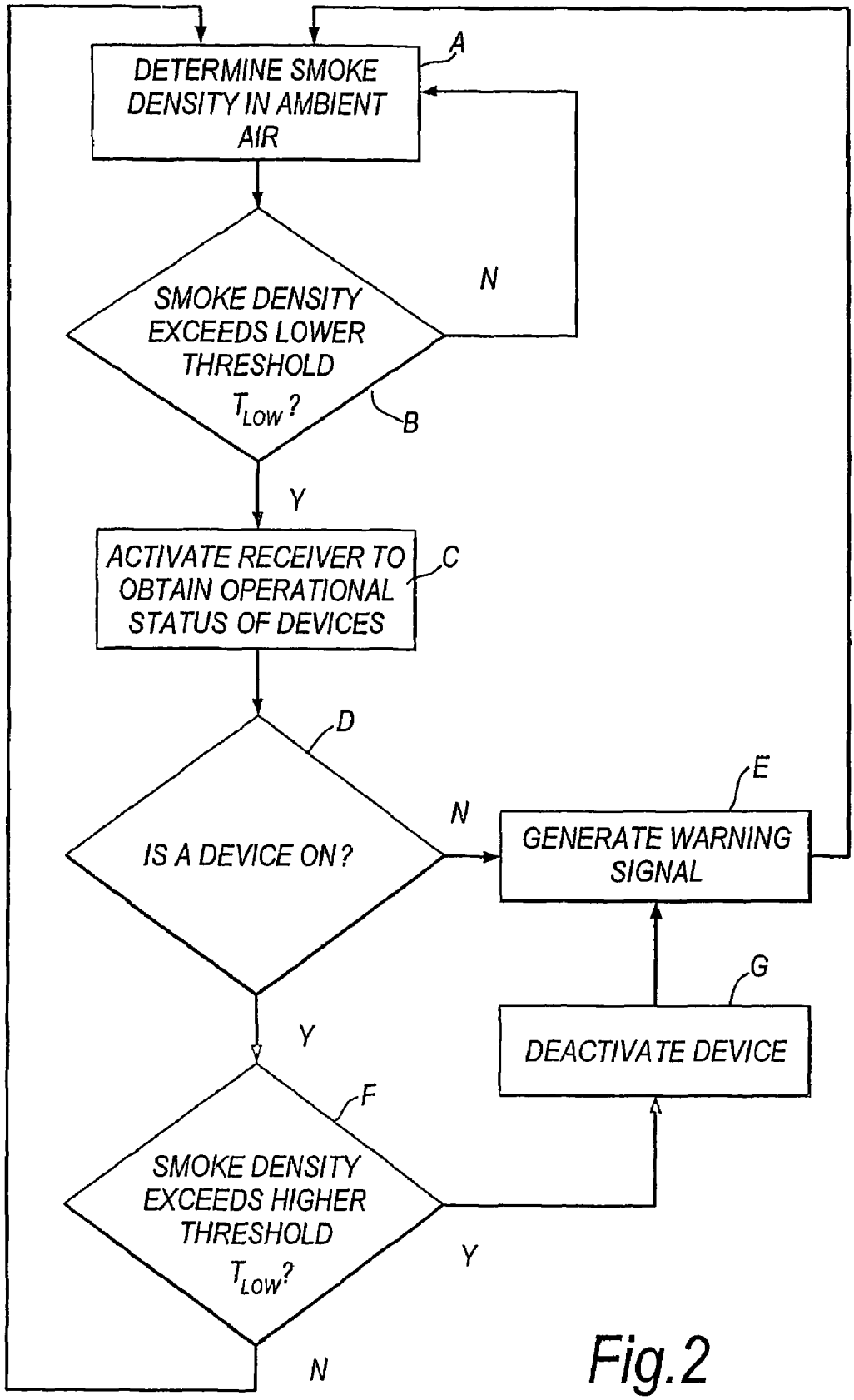
FIG. 2 is a flow chart showing operations performed by the particle detector system.

The operation of the smoke detector unit 1 and the current monitoring units 3 and 15 will now be described with reference to the flow chart of FIG. 2.

The particle detector continually produces a signal indicative of the smoke density in the ambient air in the region of the smoke detector unit 1, at step A. This signal is passed to the control unit 27 which determines whether the smoke density exceeds a lower threshold $T_{low}$ at step B. This lower threshold in this embodiment is set to correspond to the threshold which triggers a warning signal in conventional domestic smoke alarms. If, at step B, the lower threshold $T_{low}$ is not exceeded no action is taken, but the smoke density is continually monitored for any change thereto with respect to $T_{low}$ Thus far, the operation of the smoke detector unit is entirely conventional.

However, if the lower threshold $T_{low}$ is exceeded, the receiver 25 of the smoke detector unit 1 is activated to determine the operational status of the appliances 11 and 21 associated with the respective current monitoring units 3 and 15, at step C. This operational status is obtained by analysing the signals transmitted by the respective radio transmitters 13 and 23. If, at step D, it is determined that neither of the appliances 11 and 21 is on, a warning signal is generated at step E. The warning signal will activate the loudspeaker 29 to provide a warning that there is a fire risk as determined by the smoke density within the ambient air.

Therefore, the smoke detector unit 1 will have an identical sensitivity to a conventional smoke detector, when neither of the appliances 11 and 21 is operational. Therefore, an early warning of a fire hazard is received.

If, at step D, it is determined that one or both of the appliances 11 and 21 is on, a determination is made, at step F, by the control unit 27 as to whether a higher smoke density threshold $T_{high}$ is exceeded. If the higher threshold $T_{high}$ is not exceeded, no action is taken and the smoke detector unit 1 continues to monitor the smoke density in the ambient air. In conventional smoke alarm configurations having a "hush" feature mentioned above, a nuisance warning would be issued and user intervention would be required to manually invoke the higher threshold $T_{high}$, thus silencing the alarm.

In the embodiment, if the higher threshold $T_{high}$ is exceeded, a transmitter 30 of the smoke detector unit 1 is activated to transmit a signal recognisable by a receiver 32 of the relevant one of the current monitoring units 3 and 15 (that is, the current monitoring unit associated with the appliance which is producing the particles), which will cause that current monitoring unit to shut off the power supply to the relevant appliance 11 or 21, at step G. A warning signal is also sounded (step E). Similar to the warning signal of a convention smoke alarm.

The value of threshold $T_{high}$ is higher than $T_{low}$, and is set to correspond to a smoke density value which will be in excess of that produced by an appliance such as kettle 11 or toaster 21 in normal operation. However, the value of $T_{high}$ is set to a sufficiently low value that the malfunctioning of an appliance (for example the kettle 11 boiling dry, or the toaster 21 not automatically shutting off) will be identified and an appropriate warning signal provided.

Step G provides the additional advantage that the malfunctioning appliance 11 or 21 can be automatically shut off, thereby providing an important additional safety feature. Step G is, however, optional, and in a simplified system this could be omitted, making the provision of transmitter 30 and receiver 32 unnecessary.

Although an electric kettle 11 and a toaster 21 are used in the example described above, the fire warning system is equally applicable to other appliances or devices which generate non-hazardous smoke or aerosols in their normal operation, such as microwave ovens or grills. Additionally, appliances associated with, but not directly responsible for, the generation of non-hazardous smoke or aerosols can be monitored. For example, the current drawn by an electric extractor hood or fan could be monitored to determine whether this was activated, which would provide an indication that cooking was in progress and generating an appropriate signal for the receiver 25. This provides a convenient mechanism for detecting that cooking is in progress when the cooking is performed by a gas appliance. It should be understood that the operation of non-electrical items could also be determined and used in the smoke detection unit 1 by adapting the non-electrical device to generate an appropriate signal for the receiver 25 when in use.

Some appliances, such as electric cookers, are hard-wired to the mains. As an alternative to using a current monitoring unit of the configuration shown in FIG. 1, an inductive detector could be mounted around the mains supply cable to such a device in order to detect current drawn by the device. The other components of the current monitoring unit would be the same as the current monitoring units shown and described in relation to FIG. 1.

In the embodiment, the smoke detector unit 1 is arranged so that the receiver 25 is only activated when the lower threshold $T_{low}$ is exceeded, in order that the operational status of the appliances 11 and 21 can be determined at that time. This will reduce power consumption of the smoke detector unit 1, which is important if the unit 1 is battery powered. The current monitoring units 3 and 15 may transmit their operational status continuously from radio transmitters 23 and 13 because these devices are powered from mains supply sockets 7 and 19.

The current monitoring units 3 and 15 may, advantageously be provided with a visual indicator, for example an LED, 31 which indicates that the operational status of the appliance 11 or 21 connected thereto is being transmitted to the smoke detector unit 1. The smoke detector unit 1 may include a visual indicator, for example an LED 33, which is illuminated when the lower threshold $T_{low}$ is exceeded, and a second indicator 35 which indicates when the lower threshold is exceeded but that a warning signal has not been generated because one of the appliances 11 or 21 is determined to be operational.

The control unit 27 of the smoke detector unit 1 may be configured to, after it is detected that $T_{low}$ is exceeded and one of the appliances 11 and 21 is on, adopt the higher threshold $T_{high}$ (with which the smoke density measurement is compared, so as to generate a warning signal only when the smoke density exceeds the higher threshold $T_{high}$) for a predetermined period of time—for example 10 minutes. However, advantageously, the control unit reverts to comparing the measured smoke density with $T_{low}$ soon as it is determined that the relevant appliance 11 or 21 is off, thereby providing a higher level of protection. Conventional smoke alarms typically revert to $T_{low}$ threshold after a pre-set time period, thus remaining in a "de-sensitised" state longer than is perhaps necessary. It may be advantageous to incorporate a delay before $T_{low}$ is adopted after it is detected that the device is turned off in order to allow the non-hazardous smoke or aerosols generated thereby to disperse. Alternatively, the control unit 27 may monitor the smoke density and revert to the threshold $T_{low}$ soon as the ambient smoke density falls below the $T_{low}$ level. The two-way transmission of data between the smoke detector unit 1 and the current monitoring units 3 and 15, allows the following additional features to be provided:

1. Manual remote silencing of the loudspeaker 29 of the smoke detector unit 1 by activating a button (not shown) on the current monitoring unit 3 or 15.

2. Manual remote testing of the smoke detection unit 1 (for example to determine its battery status) via a button (not shown) on the current monitoring unit 3 or 15.

3. The inclusion of mains powered audible alarms or lights within the body of the current monitoring unit 3 or 15, triggered by a signal from the smoke detector unit 1.

Figure 3:
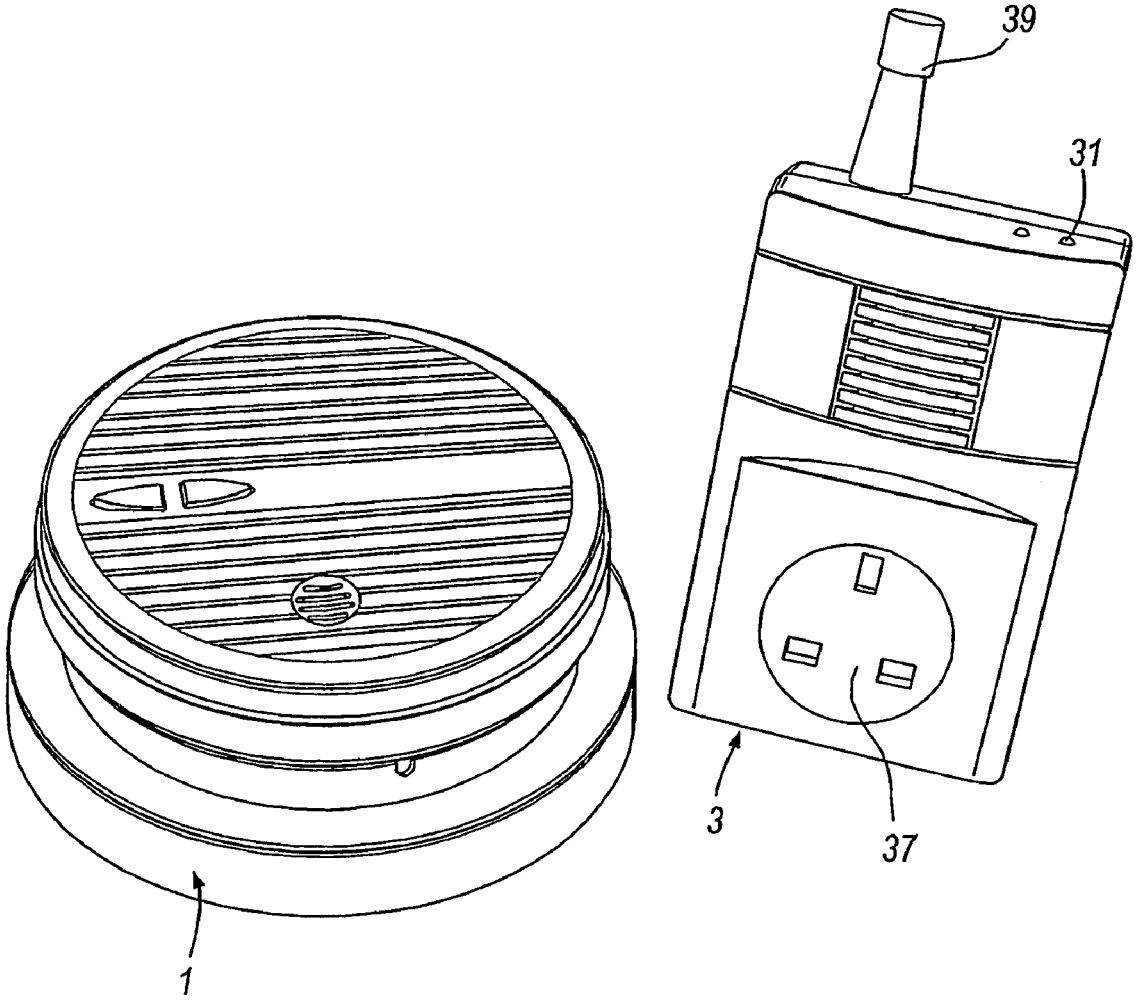
FIG. 3 shows perspective views of the particle detector unit and an appliance transceiver unit.

FIG. 3 shows in more detail an example configuration of the smoke detector unit 1 and the current monitoring unit 3. A smoke detector unit 1 is of generally conventional appearance. The conductive pin receiving sockets 37 for receiving the pins of the plug of an appliance 11 or 21 can be seen. Antenna 39 for facilitating the receiving and transmission of data from and to the smoke detector unit 1 can also be seen.

Although the embodiment described employs current monitoring units for cooperating with United Kingdom domestic mains supply sockets and plugs, it should of course be appreciated that current monitoring units of different configuration could be used. The current monitoring units 3 and 15 may, for example, be configured to cooperate with domestic plugs and sockets used in other countries. As mentioned above, the current monitoring units 3 may not cooperate with a mains supply socket at all, but they inductively monitor the current supply to a device.

Also, in the embodiment, wireless communication between the current monitoring devices 3 and 15 and the smoke detector unit 1 is described. This is a convenient method of communication because it simplifies installation of the system. However, the smoke detector unit 1 and the current monitoring units 3 and 15 may be connected together by means of especially provided cable. As an alternative to being battery operated, the smoke detector unit 1 may be mains operated. If the smoke detector unit is mains operated, mains borne signalling (i.e. coded communication via the mains electric network) may be employed between the smoke detector unit 1 and the current monitoring units 3 and 15. Ultrasonic signalling, optical (e.g. infrared) signalling or any other known method could also be used between the components of the system.

The smoke detector unit 1 and current monitoring units 3 and 5 could form part of a wider communication system where a variety of detector types (including heat, gas, etc) are able to communicate to one another and to a centrally located control unit. Such a system could also include intruder detection capabilities and remote warning features, e.g. alerts via telephone.

As mentioned above, each of the current monitoring units 3 and 15 may transmit a signal indicative of its operational status, and the signals transmitted by each current monitoring unit may in some appropriate way be distinguishable from the signals generated by other current monitoring units by the smoke detector unit 1. If this functionality is provided, the smoke detector unit 1 may select a higher threshold $T_{high}$ which has a value in dependence upon the particular device or devices which are known to be in operation. For example, a toaster may be known to generate more non-hazardous particles than a kettle. In this instance, if it is detected that only the toaster is in operation, the threshold $T_{high}$ may be set to a higher value than if it is detected that only the kettle is in operation.

A more complex arrangement could involve intelligent alarm logic based on a number of measured parameters, including the operational state of appliances known to generate non-hazardous aerosols. For instance, domestic grade smoke alarms could include detection elements sensitive to different types of smoke and heat sensitive components. The sensitivities of these separate alarm components are quite different to smouldering and flaming fires. Their sensitivities to nuisance aerosols is also different. Consequently, the decision to signal an alarm must result from a more complex logic process than simply switching to a higher alarm threshold for the system as a whole. In a modification to the embodiment described appropriate logic is provided for receiving various measurement signals indicative of a plurality of different characteristics and for comparing these to respective thresholds (which are variable as appropriate in dependence upon the detection of the operation of a device known to influence the characteristics). It is conceivable that a positive response by any of the detection components to an external event could initiate a dynamic monitoring process where all system measurands are probed more frequently and the alarm decision logic is re-evaluated continuously.

The invention claimed is:

1. A detector including detector means for detecting a predetermined characteristic of ambient fluid and for producing a measurement signal indicative of the value of that characteristic of the fluid exceeding an initial threshold value, device detection means for receiving a signal indicative of the operational status of a device known to be associated with the varying of said characteristic and for altering the threshold value in dependence upon that detection, and means for producing a warning signal when the threshold is exceeded.

2. The detector of claim 1, wherein the characteristic is the temperature of the fluid.

3. The detector of claim 1, wherein the characteristic is the quantity of a component in said fluid.

4. The detector of claim 3, wherein said component is a gas or vapour.

5. The detector of claim 3, wherein said component comprises particles.

6. The detector of claim 5, wherein said particles are smoke particles.

7. The detector of claim 1 including control means for receiving the measurement signal indicative of the value of the said characteristic exceeding the initial threshold value and for operating the device detection means to detect operation of said device in response to said measurement signal.

8. The detector of claim 1, including means for indicating the threshold value.

9. The detector of claim 1, including means for selectively deactivating the device.

10. The detector of claim 9, wherein the deactivating means deactivates the device when the altered threshold associated with operation of that device is exceeded.

11. The detector of claim 9, wherein the deactivating means deactivates the device by means of wireless communication.

12. The detector of claim 1, wherein the device detection means includes a receiver for receiving by wireless communication a signal indicative of the operational state of the device.

13. The detector of claim 1, wherein the device is located remotely from the detector.

14. The detector of claim 1, wherein a plurality of different characteristics are detected and respective measurement signals produced that are indicative of the value of those characteristics exceeding respective thresholds, wherein at least some of those thresholds are altered in dependence upon the operational status of a device known to be associated with the varying of the relevant characteristic.

15. A detector system including detection means for detecting a predetermined characteristic of ambient fluid and for producing a measurement signal indicative of the value of said characteristic of the fluid exceeding an initial threshold value, monitoring means for producing a monitoring signal indicative of the operation of a device, the operation of which device is associated with the varying of said characteristic, and means for receiving the monitoring signal and for altering the threshold value in dependence upon the signal, and means for producing a warning signal when said threshold value is exceeded.

16. The detector system of claim 15, wherein the characteristic is the temperature of fluid.

17. The system of claim 15, wherein the characteristic is the quantity of a component in said fluid.

18. The system of claim 17, wherein said component is a gas or a vapour.

19. The system of claim 17, wherein said component comprises particles.

20. The system of claim 19, wherein the particles are smoke particles.

21. The system of claim 15, including control means for receiving the measurement signal indicative of the value of said characteristic exceeding the initial threshold value and for operating said means for receiving the monitoring signal in response to said measurement signal.

22. The system of claim 15, including means for indicating the threshold value.

23. The system of claim 15, including means for selectively deactivating the device.

24. The system of claim 23, wherein the deactivating means deactivates the device when the altered threshold associated with operation of that device is exceeded.

25. The system of claim 23; wherein the deactivating means deactivates the device by means of wireless communication.

26. The system of claim 15, wherein the monitoring means comprises a module operatively coupled between the device and the power supply for that device.

27. The system of claim 26, including means for selectively deactivating the device, and wherein said module includes means for receiving a deactivation signal from the deactivating means for cutting the supply of power to the device.

28. The system of claim 26, wherein the module includes a transmitter for transmitting by wireless communication a signal indicative of the status of the device associated therewith.

29. The system of claim 15, wherein the device is located remotely from the detection means.

30. The system of claim 15, including a plurality of monitoring means for monitoring respective devices.

31. The detector system of claim 15, wherein a plurality of different characteristics are detected and respective measurement signals produced that are indicative of the value of those characteristics exceeding respective thresholds, wherein at least some of those thresholds are altered in dependence upon the operational status of a device known to be associated with the varying of the relevant characteristic.

32. A method of fire protection including providing detection means for detecting a predetermined characteristic of ambient fluid and for producing a measurement signal indicative of the value of the characteristic; providing one or more known devices, the operation of which is associated with varying said characteristic, with monitoring means for providing a signal to the detection means indicative of the operational status of the device with which the monitoring means is associated; monitoring the measurement signal to determine whether it exceeds an initial threshold value; in response to the exceeding of said threshold value, obtaining and analysing the signal from the or each monitoring device, and producing a warning signal if said analysis indicates that the device is inoperative, and otherwise increasing the threshold value temporarily and producing a warning signal if the increased threshold value is exceeded.

33. The method of claim 32, wherein the characteristic is the temperature of the fluid.

34. The method of claim 32, wherein the characteristic is the quantity of a component in the fluid.

35. The method of claim 34, wherein said component is a gas or a vapour.

36. The method of claim 34, wherein said component comprises particles.

37. The method of claim 32, wherein the threshold value is returned to the initial value after a predetermined period of time.

38. The method of claim 37, wherein the threshold value is returned to the initial value when monitoring means indicates that the device is no longer operative.

39. The method of claim 32, including locating the particle detection means remotely from the or each device.

* * * * *